United States Patent [19]

Fox et al.

[11] Patent Number: 4,564,283

[45] Date of Patent: Jan. 14, 1986

[54] BLADE CLEANER APPARATUS FOR REMOVING TONER FROM A CHARGE-RETENTIVE SURFACE

[75] Inventors: Wayne D. Fox; Barry J. Gheer, both of Rochester, N.Y.

[73] Assignee: Xerox Corporation, Stamford, Conn.

[21] Appl. No.: 623,067

[22] Filed: Jun. 22, 1984

[51] Int. Cl.[4] ..... G03G 21/00

[52] U.S. Cl. ..... 355/15; 355/3 DD; 118/652; 15/256.51

[58] Field of Search ..... 355/15, 3 DD, 3 R; 118/652; 430/125; 15/1.5, 256.5, 256.51

[56] References Cited

U.S. PATENT DOCUMENTS 3,863,603 2/1975 Buckley et al. ..... 355/3 DD 4,400,082 8/1983 Kiba ..... 355/15

OTHER PUBLICATIONS

Xerox Disclosure Journal, vol. 8, No. 3, dated May/-Jun. 1983, entitled: End Seal for Blade Cleaner; author: Thomas J. Lynch.

*Primary Examiner*—R. L. Moses

[57] ABSTRACT

Blade cleaner apparatus for removing residual toner from a charge-retentive surface including a cleaner housing having a cleaning blade disposed therein adjacent the top thereof. The apparatus is characterized by improved means for reducing the escape of toner particles from the housing. Seals are disposed between the blade ends and side frame members. The seals block the flow of toner laden air past the ends of the cleaning blade. Thus, the toner laden air flow is redirected to behind the blade which allows toner to separate from the air prior to its exodus from the cleaner housing area.

20 Claims, 3 Drawing Figures

BLADE CLEANER APPARATUS FOR REMOVING TONER FROM A CHARGE-RETENTIVE SURFACE

This invention relates to printing machines, and more particularly, to a blade cleaner apparatus for removing residual toner from a charge-retentive surface utilized therein.

In printing arts of the type contemplated, a charge-retentive surface such as a photoconductor or photoreceptor which comprises a photoconductive insulating material adhered to a conductive backing is charged uniformly. Then the photoreceptor is exposed to a light image of an original document to be reproduced. The latent electrostatic images, thus formed, are rendered visible by applying any one of numerous pigmented resins specifically designed for this purpose. In the case of a reusable photoreceptor, the pigmented resin, more commonly referred to as toner which forms the visible images is transferred to plain paper. After transfer, toner images are made to adhere to the copy medium usually through the application of heat and pressure by means of a roll fuser.

Although a preponderance of the toner forming the images is transferred to the paper during transfer, some toner remains on the photoreceptor surface, it being held thereto by relatively high electrostatic and/or mechanical forces. It is essential for optimum operation that the toner remaining on the surface be cleaned thoroughly therefrom.

An example of a cleaner that has become commercially successful is the blade cleaner. Blade cleaners have become quite popular in recent years due to their simplicity in construction, and their high degree of effectiveness in residual toner removal. When a cleaning blade is positioned above the surface to be cleaned, the toner rapidly builds into a pile in front of the blade which traps and agglomerates the toner particles thereby precluding undesirable powder clouding. However, removal of the toner away from the charge-retentive surface thus accumulated is more difficult than when the blade is positioned below the photoreceptor or adjacent a vertical section thereof. Removal of toner from a charge-retentive surface such as a photoreceptor is accomplished by mechanical interaction of the blade with the moving surface. When the blade contacts a vertical section of the photoreceptor, the toner is propelled away from the blade in a fan-like pattern thus creating toner clouding. The moving charge-retentive surface carries air into the cleaner cavity or housing due to its motion. The air tends to pump around the ends of the blade thereby carrying some of the toner out of the cleaner housing with it. The foregoing results in the contamination of other areas of the machine, thus adversely affecting machine functions, for example, charging and exposure.

The foregoing problem is greatly reduced, if not completely eliminated, by the present invention in a blade cleaner apparatus wherein no other precautions have been taken to contain the toner particles within the toner housing. To this end, fabric or pile material constituting fur seals are mounted intermediate each end of the cleaning blade and an adjacent wall or side frame of the machine. The seals serve to prevent toner laden air from bypassing the ends of the blade.

During normal operation of the cleaner apparatus herein disclosed, the blade is required to both translate and rotate. Accordingly, another feature of the present invention is the provision of seals that not only block the toner from being pumped past the blade ends but also are constructed such that they do not act as an impediment to the translation and rotation of the blade and blade holder.

In operation, the air being pumped at a relatively high velocity by the charge-retentive surface is blocked by the seals from moving past the ends of the blades and out of the cleaner housing and it is redirected at a lower velocity into an area of the cleaner housing behind the blade where the toner particles, due to the lower air velocity, can settle out of the air before the air exits the cleaner housing to other areas of the machine.

By the provision of the end seals of the present invention, we have found that it is possible to operate a blade cleaner apparatus without the use of toner containment devices such as those disclosed in copending application Ser. No. 623,592 assigned to the same assignee as the instant application and U.S. patent application Ser. No. 527,160, filed on Aug. 29, 1983, also assigned to the same assignee as the instant invention. Thus, the sole means for containment of toner within the cleaner housing of the present invention comprises the end seals disclosed hereinbelow.

It was known to use end seals as disclosed in Xerox Disclosure Journal, Volume 8, Number 3, dated May/-June 1983 which was published on June 10, 1983. Such disclosure does not suggest only the use of end seals and it teaches the use of short nap fabric which is not suitable for a cleaner device when the blade has to rotate and oscillate.

Other aspects of the present invention will become apparent as the following description proceeds with reference to the drawings.

Inasmuch as the art of electrophotographic printing is well known, the various processing stations employed in the printing machine illustrated in FIG. 1 will be described only briefly.

Figure 1:
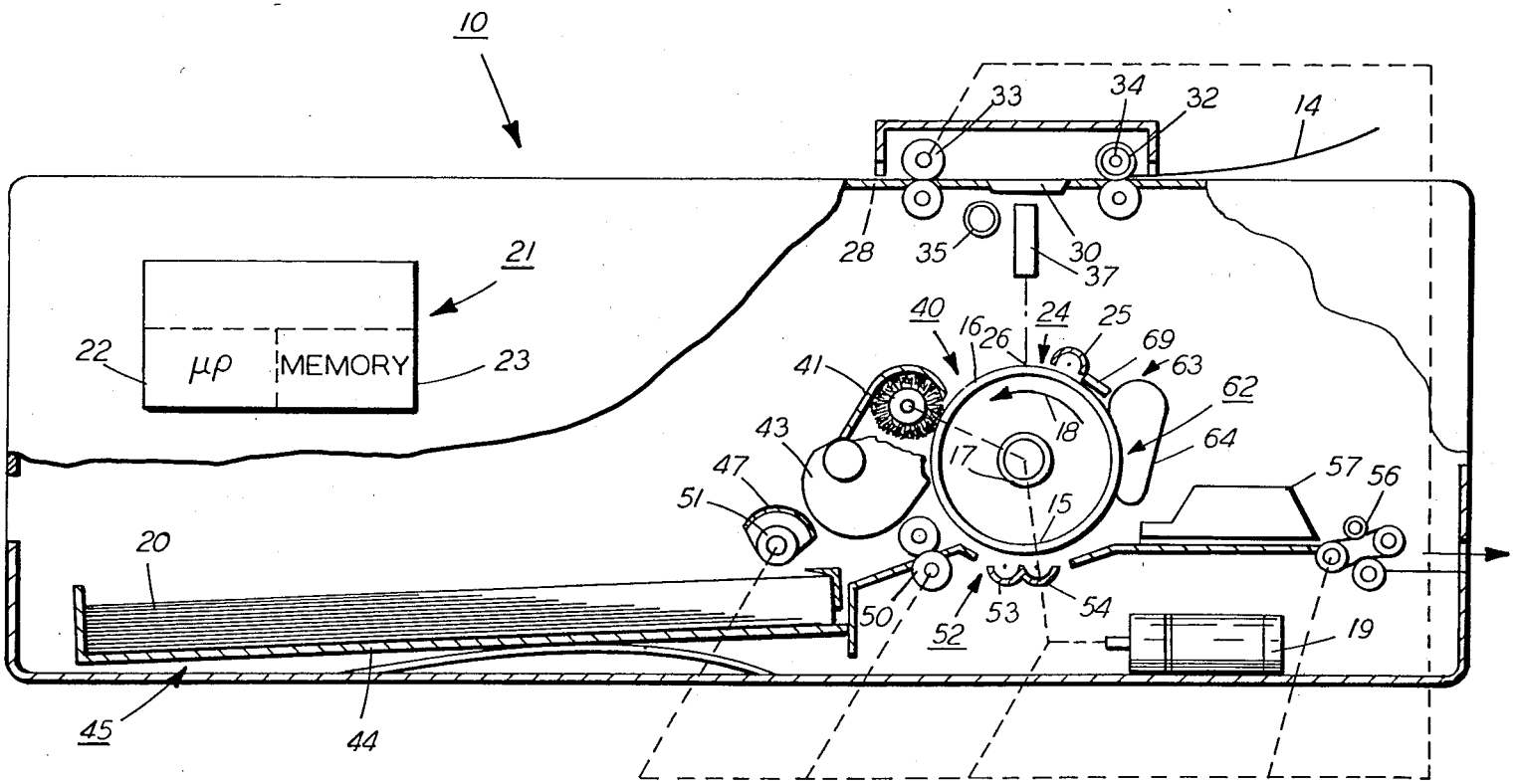
FIG. 1 is a schematic elevational view depicting an electrophotographic printing machine incorporating the present invention.

Referring to FIG. 1 of the drawings, there is shown by way of example an automatic xerographic reproduction or printing machine, designated generally by the numeral 10 incorporating the cleaner apparatus of the present invention.

The reproduction machine 10 depicted in FIG. 1 illustrates the various components utilized in machines of this type for producing copies of a document original 14. Although the cleaner apparatus of the present invention is particularly well adapted for use in reproduction machines 10, it should become evident from the following description that it is equally well suited for use in a wide variety of other reproduction and printing machine types and systems and is not necessarily limited in application to the particular embodiment or embodiments shown herein.

Reproduction machine 10 has an image recording photoreceptor or any suitable charge-retentive surface 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19, photoconductive surface 16 of photoreceptor 15 past a series of xerographic processing stations. A suitable controller 21 with microprocessor 22 and memory 23 is provided for operating in a predetermined timed relationship with various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33 is provided for transporting the document original past scan slit 30. Roll pairs 32, 33 are drivingly coupled to main drive motor 19, roll pair 32 being coupled through an electromagnetically operated clutch 34. A suitable document sensor 31 (not shown) is provided at the inlet to platen 28 for sensing the insertion of document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37 which may, for example, comprise an array of gradient index fiber elements, is provided to optically transmit the image rays reflected from the line-like portion of the document original being scanned to the photoconductive surface 16 of photoreceptor 15 at exposure station 26.

Following exposure, the latent image on the photoconductive surface 16 of photoreceptor 15 is developed at a development station 40. There, a suitable developer such as magnetic brush roll 41, which is drivingly coupled to main drive motor 19, brings a suitable developer mix in developer housing 43 into developing relation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets into operative relationship with segmented feed rolls 47. Feed rolls 47 are driven by main drive motor 19 through an electromagnetically operated clutch 51. Rolls 47 serve upon actuation of clutch 51 to feed the topmost copy sheet forward into the nip of a registration roll pair 50 which register the copy sheet with the image on the photoconductive surface 16 of photoreceptor 15. Registration roll pair 50 advances the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57, which may, for example, comprise a radiant type fuser, where the image is permanently fixed to the copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Following transfer, residual developer remaining on the photoconductive surface 16 of photoreceptor 15 is removed at cleaning station 62 by means of cleaning apparatus 63. Developer removed by cleaning apparatus 63 is deposited into a suitable collector or cleaner housing 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any suitable charges on the photoconductive surface 16 or trapped in the photoreceptor bulk be removed prior to charging. An erase device 69 is provided for this purpose.

Figure 2:
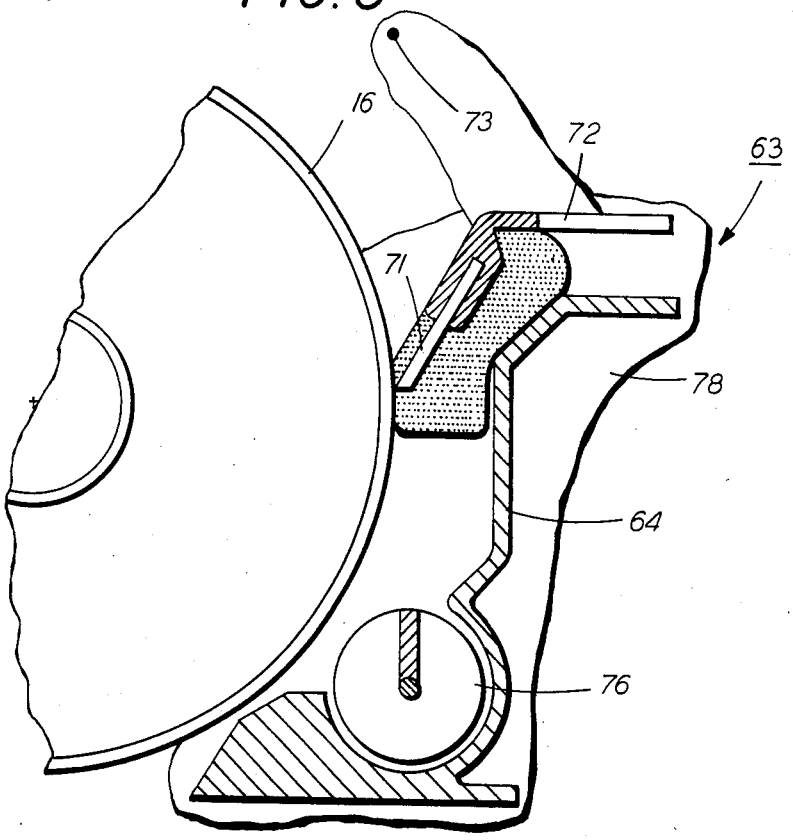
FIG. 2 is an enlarged fragmentary view of a cleaner apparatus representing the invention.

As disclosed in FIG. 2, the cleaning apparatus 63 comprises a blade holder 72 having a groove or slot into which a conventional cleaning blade 71 is inserted. The holder is movably mounted on a pivot 73 such that the blade edge contacts the photoreceptor surface in the manner shown. The blade holder is adapted to be pivoted into and out of engagement with the photoreceptor, the former being effected during operation and the latter being effected during non-operating periods. The blade holder is also adapted to move from side to side in a reciprocating manner so as to reduce photoreceptor and cleaning blade wear and enhance cleaning. Both the rotation and reciprocation of the blade holder and, therefore, the blade can be effected in any well known manner (not shown).

The cleaning apparatus 63 comprises the residual toner collector 64 into which the residual toner removed from photoconductor surface 16 falls. Disposed in the bottom of the collector 64 is an auger 76 which moves the residual toner to one end of the collector where it falls through an opening (not shown) in the bottom wall of the collector on its way to a collection receptable (also not shown).

Figure 3:
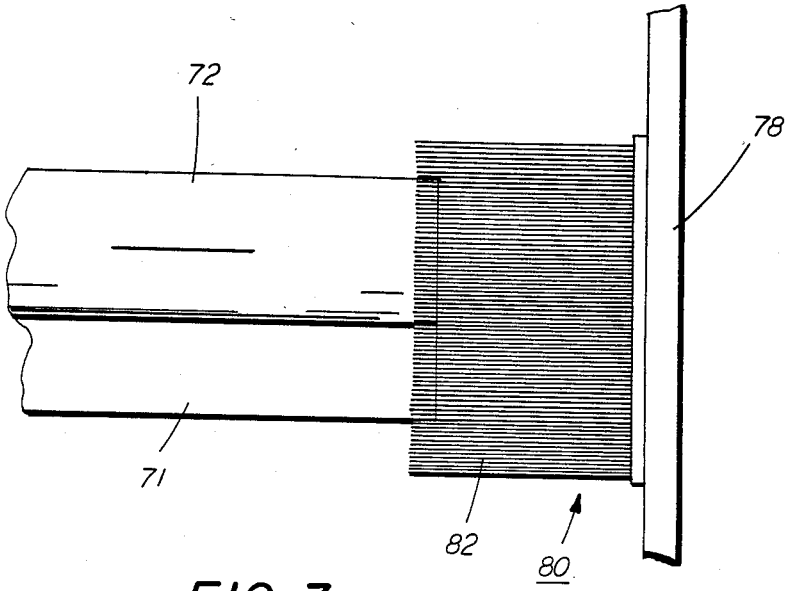
FIG. 3 is an enlarged fragmentary view of an end seal forming a part of the cleaner apparatus of FIG. 2.

As can be see from FIGS. 2 and 3, one of a pair of end seals 80 is positioned intermediate the end of the blade and one of a pair of side frames 78. As illustrated, one of the pair of fabric seals 80 is secured to the side frame 78 such that the free ends of the fibers 82 receive the ends of the blade 71 and blade holder 72. The seals serve to block air flow created by photoreceptor and cause the toner laden air to be redirected behind the blade 71. As a result of such redirection, the velocity of the air is significantly lowered thereby enabling the toner contained therein to fall out of the air and into the collector 74. Now when the air escapes from the area of the cleaning apparatus 63 into other areas of the machine it is substantially free of toner.

The seals are constructed so that they do not impede rotational and reciprocating movement of the blade and blade holder. They exhibit good spring back properties so that they can return to their upstanding position upon movement of the blade and blade holder in a direction away from certain of the fibers. They do not crush or mat down upon installation of the blade structure.

Fibers that have proven satisfactory have been fabricated from polypropylene material and are at least $\frac{3}{4}$ of an inch long and 0.001 inch in diameter. The seals 80 which comprise such fibers are approximately $\frac{1}{2}$ by 1 inch in vertical cross section. The seals are secured to the side frames in any suitable manner. When installed, the fibers contact the photoreceptor, blade and blade holder and the back wall of the collector 64. Suitable seals have been procured from the Schlegel Corporation of Rochester, N.Y.

We claim:

1. Cleaner apparatus for removing residual toner from a charge-retentive surface movable through an endless path, said apparatus comprising:

a cleaner housing;

a blade and blade holder supported such that the blade's edge contacts the charge-retentive surface; and means contacting the ends of said blade and blade holder, said charge-retentive surface and said cleaner housing to block air movement created by the movement of said charge-retentive surface past the ends of said blade thereby redirecting the air movement to an area behind said blade whereby toner contained in said air separates therefrom.

2. Apparatus according to claim 1 wherein said contacting means comprises a pair of seal members.

3. Apparatus according to claim 1 including means for supporting said blade and blade holder for rotational and reciprocating movement.

4. Apparatus according to claim 3 wherein said contacting means comprises a pair of seal members containing elongated fibers.

5. Apparatus according to claim 4 wherein said fibers comprise polypropylene.

6. Apparatus according to claim 4 wherein said fibers are sufficiently long and flexible to allow movement of said blade and blade holder without causing appreciable matting of the fibers.

7. Apparatus according to claim 6 wherein said fibers are fabricated from polypropylene.

8. Apparatus according to claim 7 wherein said fibers have a diameter on the order of 0.001 inch and are approximately $\frac{3}{4}$ of an inch in length.

9. Apparatus according to claim 1 wherein said contacting means are the only means in said apparatus for impeding air movement.

10. Apparatus according to claim 4 wherein said seal members are the only seal members in said apparatus.

11. Printing apparatus comprising:

a charge-retentive surface;

means including toner for forming visible images on said charge-retentive surface;

a housing;

a blade holder in said housing;

a blade member supported within said housing by said blade holder; and means contacting the ends of said blade and blade holder, said charge-retentive surface and said cleaner housing to block air movement created by the movement of said charge-retentive surface past the ends of said blade thereby redirecting the air movement to an area behind said blade whereby toner contained in said air separate therefrom.

12. Apparatus according to claim 11 wherein said contacting means comprises a pair of seal members.

13. Apparatus according to claim 11 including means for supporting said blade and blade holder for rotational and reciprocating movement.

14. Apparatus according to claim 13 wherein said contacting means comprises a pair of seal members containing elongated fibers.

15. Apparatus according to claim 14 wherein said fibers comprise polypropylene.

16. Apparatus according to claim 14 wherein said fibers are sufficiently long and flexible to allow movement of said blade and blade holder without causing appreciable matting of the fibers.

17. Apparatus according to claim 16 wherein said fibers are fabricated from polypropylene.

18. Apparatus according to claim 17 wherein said fibers have a diameter on the order of 0.001 inch and are approximately $\frac{3}{4}$ of an inch in length.

19. Apparatus according to claim 11 wherein said contacting means are the only means in said apparatus for impeding air movement.

20. Apparatus according to claim 14 wherein said seal members are the only seal members in said apparatus.

* * * * *